US005423388A

United States Patent [19]

Hale

[11] Patent Number: 5,423,388

[45] Date of Patent: Jun. 13, 1995

[54] DIRECTION CONTROLLABLE SUBSURFACE BOREHOLE TOOL

[76] Inventor: Robert G. Hale, 4201 S. 4th St., Chickasha, Okla. 73018

[21] Appl. No.: 287,449

[22] Filed: Aug. 8, 1994

[51] Int. Cl.[6] ..... E21B 7/06

[52] U.S. Cl. ..... 175/74; 175/79

[58] Field of Search ..... 175/45, 61, 62, 73, 175/74, 78, 80

[56] References Cited

U.S. PATENT DOCUMENTS

| | | | |
|---|---|---|---|
| 1,636,032 | 7/1927 | Abbott | 175/80 |
| 2,492,794 | 12/1949 | Goble et al. | 175/45 |
| 3,961,674 | 6/1976 | Craig, Jr. et al. | 175/73 X |
| 4,076,084 | 2/1978 | Tighe | 175/61 X |
| 4,453,603 | 6/1984 | Voss et al. | 175/53 |
| 4,993,503 | 2/1991 | Fischer et al. | 175/62 |
| 5,002,138 | 3/1991 | Smet | 175/45 |
| 5,052,502 | 10/1991 | Jürgen et al. | 175/80 |
| 5,078,218 | 1/1992 | Smet | 175/45 |

*Primary Examiner*—Ramon S. Britts
*Assistant Examiner*—Frank S. Tsay
*Attorney, Agent, or Firm*—Robert K. Rhea

[57] ABSTRACT

A drilling head for making a borehole along a predetermined underground path is formed by a tubular body having a guidable rotary drilling sub normally axially mounted in the body by means of a sleeve bearing journalling a drill bit equipped rotary drilling string sub joint moveable with and within the sleeve for disposing the drilling bit on a predetermined angle in a predetermined direction relative to the longitudinal axis of the body by means of diametrically opposite superposed pairs of wedges interposed between respective end portions of the sleeve bearing and the inner periphery of the body.

3 Claims, 3 Drawing Sheets

DIRECTION CONTROLLABLE SUBSURFACE BOREHOLE TOOL

This invention generally relates to subsurface horizontal borehole drilling for installing communication lines such as optical cables across a highway right-of-way and more particularly to a direction controllable boring tool capable of crossing a highway where the surface of the earth on either side of the highway is substantially equal to the elevation of the roadway.

BACKGROUND OF THE INVENTION

1. Field of the Invention

Forming a borehole transversely of a highway necessitates that the boring tool be capable of being angled downwardly at one side of the highway and then turned in an upward direction while beneath the highway to emerge through the surface of the earth on the opposite side of the highway. This boring tool is capable of accomplishing this function.

2. Description of the Prior Art

U.S. Pat. No. 5,002,138 issued Mar. 26, 1991 and U.S. Pat. No. 5,078,218 issued Jan. 7, 1992 to Smet for STEERABLE DRILLING MOLE both disclose a down hole motor connected with a steering element in turn obliquely connected with a drill head driven by a drilling motor. The motors has a part spherical ball at its rearward end in a guide socket by operating the motor and turning the guide element the motor and the drill bit is disposed in a desired upward or lateral direction monitored as indicated by a monitoring device rearwardly of the motor.

U.S. Pat. No. 4,453,603 issued Jun. 12, 1984 to Voss et al for APPARATUS AND METHOD FOR SELECTED PATH DRILLING and U.S. Pat. No. 4,993,503 issued Feb. 19, 1991 to Fisher et al for HORIZONTAL BORING APPARATUS AND METHOD illustrate the general state-of-the-art. The Voss patent disclosing hydraulic rams moving a hole forming apparatus under an obstruction with the small hole later enlarged as by reaming for installing wiring or optical cable in which the hole may be cased by a pipe forced into the large borehole. The Fisher patent discloses a boring apparatus having an angle cutting head which by its rotation forms a borehole substantially larger than the drill string connected with a cutting head. When it is desired to change the direction of the borehole the rotation of the drill string is stopped and the drill bit is forced into the soil and utilizes a jet stream which starts a hole at an angle to the previously drilled borehole.

This invention is believed distinctive over the above patents by mounting a drill head between cooperating pairs of longitudinally spaced tapered surface wedges concentrically supporting a drill bit on a drill string subjoint within a casing moved forwardly in response to the hole forming action of the drill bit. The drill bit may be oriented in an upward direction by interrupting forward movement of the casing and moving the drill string and drill bit forwardly relative to the casing in which moveable wedges moving longitudinally relative to stationary wedges tilts the forward end of the drilling head in an upwardly inclined direction.

SUMMARY OF THE INVENTION

A casing size sleeve like drilling head body is axially connected to the end of a length of casing to be inserted into a borehole. The drill head axially supports a non-rotating sleeve bearing between superposed pairs of wedges for longitudinal movement of the sleeve bearing in a forward direction relative to the drilling head body which inclines the sleeve bearing in an upward direction when moved forwardly relative to the drilling head body.

The sleeve bearing journals the forward end portion of a drill string subjoint having a drill bit at its earth penetrating end of slightly greater diameter with respect to the outside diameter of the drilling head body. Longitudinally spaced stops on the drill string limit forward and rearward movement of the sleeve bearing relative to the drilling head sleeve. The drill bit may be oriented in an upward direction by interrupting forward movement of the casing and moving the drill string and drill bit forwardly relative to the casing in which moveable wedges moving longitudinally relative to stationary wedges tilts the forward end of the drilling head body in an upwardly inclined direction.

The principal object of this invention is to provide a direction controllable earth boring tool for traversing a roadway right-of-way, or the like.

Figure 1:
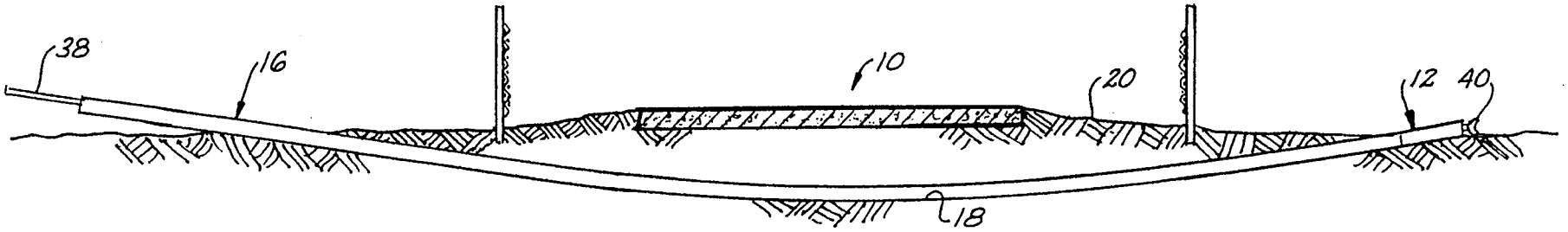
FIG. 1 is a diagrammatic cross sectional view of highway right-of-way illustrating the boring tool in operative position.
Figure 3:
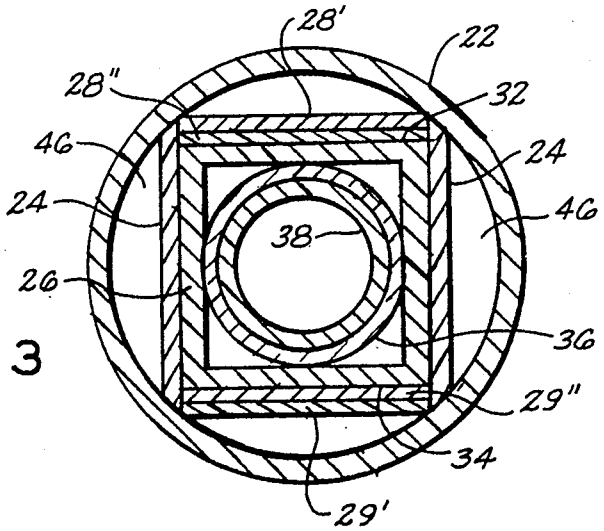
FIG. 3 is a vertical cross sectional view taken substantially along the line 3—3 of FIG. 2; and, FIG. 4 is a view similar to FIG. 2 illustrating the drill bit portion of the tool oriented in an upward direction.
Figure 2:
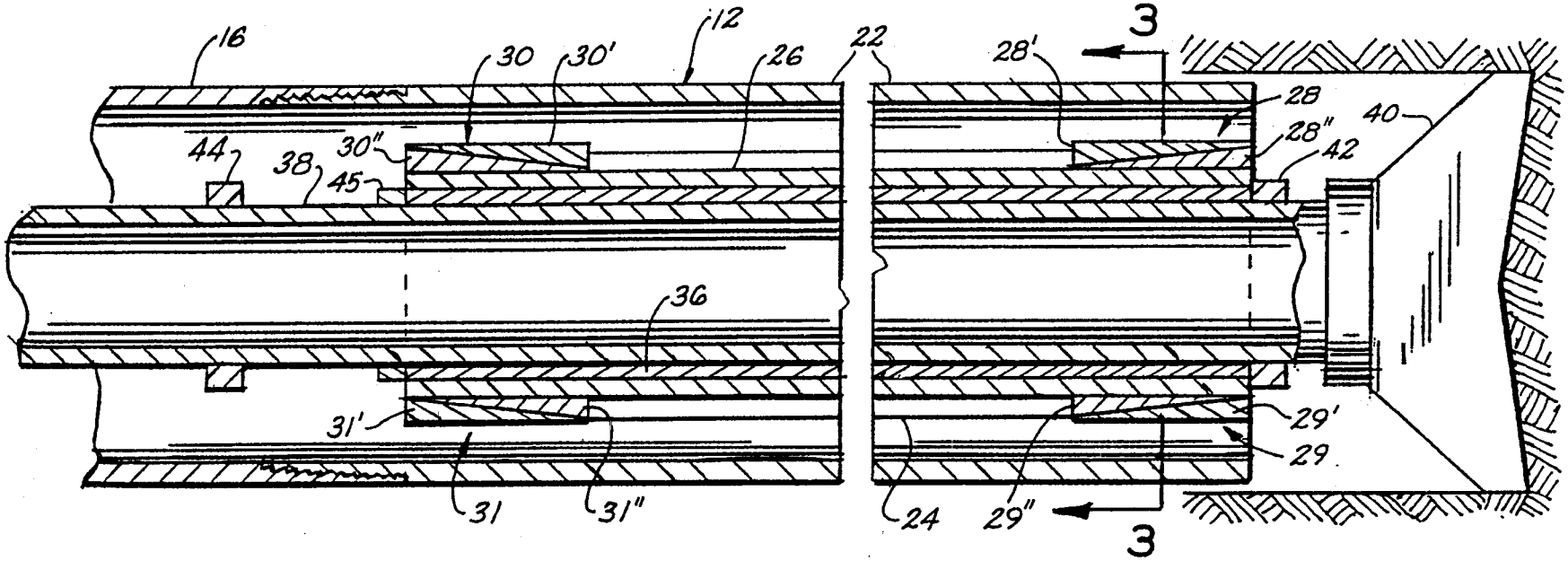
FIG. 2 is a fragmentary longitudinal cross sectional view of the boring tool to a larger scale.

The reference numeral 10 indicates a highway right-of-way under which the tubular boring tool 12 has formed a borehole 18 by its forward rotating bit 40 being pushed by a continuous length of pipe 16 into the borehole below the surface of the earth 20.

The borehole tool 12 is formed by an outer sleeve or tubular body 22 having a predeterminded length, for example, 12 inches (30.48 cm) and a diameter 3½ to 4 (8.89 to 10.16 cm) inches.

A pair of wall plates 24 substantially coextensive with the sleeve 22 are disposed in spaced apart parallel relation and secured to the inner surface of the body 22 for guiding a box channel 26 in longitudinal sliding movement relative to the body 22, as presently explained.

Upper and lower superposed pairs of wedge guides 28, 29, 30 and 31 respectively over and underlie the forward and rearward end portions of the box channel upper surface 32 and depending surface 34 to form a change of direction guide, as presently explained.

The outermost wedge guides 28'–29' and 30'–31' are secured to the inner surface of the body 22 at its respective end portions and the respective upper and lower limits of the wall guides 24 are secured to the body 22.

The inner most guides 28''–29''and 30''–31''are cooperatively secured to the upper and lower surfaces 32 and 34, respectively, of the box channel 26 at its respective end portions for longitudinal movement with the box channel relative to the body respective companion wedge guides 28'–29' and 30'–31', as presently explained.

A bearing sleeve 36 is coextensive with and secured to the inner wall surfaces of the box channel 26 for journalling the forward end portion of a subjoint on a rotary drill string 38 having a drill bit 40 connected with its forward end. In addition to being journalled by the sleeve bearing 36 the drill string 38 is longitudinally moveable a selected distance relative the sleeve bearing, being limited by a forward stop 42 and a rearward stop 44 spaced a predetermined distance rearwardly of the box channel 26, a distance slightly less than the longitudinal length of the respective pairs of the wedge guides for the reasons believed presently apparent. A ring 45 surrounds the drill string subjoint adjacent the rearward end of the channel 26 for longitudinal movement of the box channel with the drill string as presently explained.

OPERATION

In operation the drill string 38 is angularly rotated to rotate the bit 40 in an earth boring action and the body 22 is moved by the casing 16 in a forward direction as the drill bit penetrates the earth 20 while simultaneously other surface equipment, such as a drilling rig including pipe handling equipment and a mud pump as disclosed by the above named U.S. Pat. No. 4,453,603 pumps drilling mud forwardly through the drill string 38 and through the bit 40 in a conventional oil-well borehole drilling manner. The drilling mud is circulated by returning through the body spaces 46, between the inner surface of the body 22, the guide walls 24, box tube 26 and in the annulus of the casing 16 around the drilling string 38 to a mud pump, not shown.

At a selected position from the point of earth entry the drill string 38 and box channel 26 are moved in a forward direction, relative to the body 22 a selected distance or until the rearward stop 44 contacts the rearward end surface of the box channel guide walls 23 and the rearward end of the wedge guide 31'.

Figure 4:
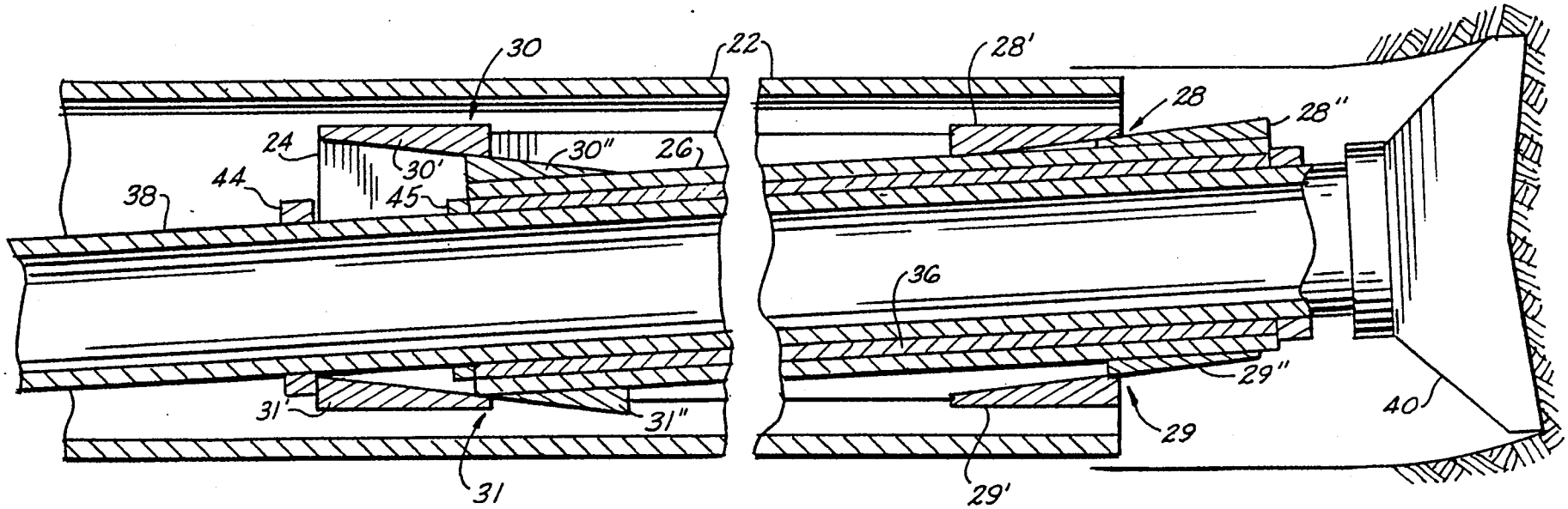

The forward movement of the box channel 26 by the cooperative shape of the pairs of wedge guides 28–31 lowers the rearward end portion of the box channel and lifts the forward end portion of the box channel 26 and the bit 40 upwardly at a small angle relative to the body 22, for example, 3 to 4 degrees which inclines the direction of drilling toward the opposite side of the roadway, as illustrated by FIG. 4.

After changing the direction to an upwardly inclined angle the drilling string forward end portion is then repositioned in the box channel 26, (by moving the casing 16 forwardly) so that the remaining or outward end portion of the borehole 18 emerges from the surface of the earth opposite the point of entry of the highway.

Obviously the invention is susceptible to changes or alterations without defeating its practicability. Therefore, I do not wish to be confined to the preferred embodiment shown in the drawings and described herein.

I claim:

1. A direction controllable drilling head for forming a borehole along a selected underground path, comprising:

an elongated tubular body having forward and rearward ends and an inner periphery and adapted to be axially connected at its rearward end with one end of a length of casing and longitudinally moved by the casing in a borehole;

a sleeve bearing having an outer periphery in said body and longitudinally moveable relative to said body;

cooperating pairs of superposed wedge means interposed in diametric opposition between the inner periphery of said body and the outer periphery of said sleeve bearing at respective end portions of the latter for normally concentrically supporting said sleeve bearing in said body; and, a rotary drill pipe subjoint adapted to be connected at one end with a rotary drill string and having a drill bit, of at least slightly larger diameter than said body, on its other end projecting beyond the forward end of said body, said subjoint journalled by said sleeve bearing and longitudinally moveable with said sleeve bearing relative to said body, whereby longitudinal movement of said sleeve bearing and said subjoint relative to said body in a borehole forming direction moves one wedge of said pairs of wedges relative to the other wedge of the respective pair of wedges and changes the longitudinal axes of said sleeve bearing and said subjoint to a predetermined angle and in a preselected direction relative to the longitudinal axis of said body.

2. The drilling head according to claim 1 and further including:

a guide sleeve interposed between said sleeve bearing and said pairs of wedges.

3. The drilling head according to claim 2 and further including:

stops on each end portion of said subjoint at respective ends of said sleeve bearing for limiting longitudinal movement of said subjoint relative to the sleeve bearing.

* * * * *